United States Patent [19]

Kempisty, Jr. et al.

[11] 4,037,184

[45] July 19, 1977

[54] LOCKOUT AND COVER INTERLOCK FOR CIRCUIT BREAKER

[75] Inventors: Francis W. Kempisty, Jr.; John L. Lundgren, both of Philadelphia, Pa.

[73] Assignee: I-T-E Imperial Corporation, Spring House, Pa.

[21] Appl. No.: 675,261

[22] Filed: Apr. 9, 1976

[51] Int. Cl.[2] ..... H01H 83/00; H01H 33/48

[52] U.S. Cl. ..... 335/6; 200/50 A; 335/160; 335/172

[58] Field of Search ..... 335/6, 160, 172, 202, 335/132, 21 (38); 200/50 A, 50 AA

[56] References Cited

U.S. PATENT DOCUMENTS

| | | | |
|---|---|---|---|
| 3,368,053 | 2/1968 | Groves | 200/50 A |
| 3,826,951 | 7/1974 | Mater et al. | 335/160 |
| 4,000,478 | 12/1976 | Jencks et al. | 200/50 A |

*Primary Examiner*—Harold Broome

*Attorney, Agent, or Firm*—Ostrolenk, Faber, Gerb & Soffen

[57] ABSTRACT

A molded case multi-pole circuit breaker is provided with a solid state trip unit having removable and replaceable rating plug. A mechanical interlock trips the circuit breaker when a cover portion thereof is opened. This cover portion must be opened to gain access to the rating plug. A mechanical lockout device is actuated when rating plug is removed to maintain the breaker tripped and to prevent resetting thereof until a rating plug is reinserted in the trip unit.

7 Claims, 10 Drawing Figures

LOCKOUT AND COVER INTERLOCK FOR CIRCUIT BREAKER

This invention relates to molded case multi-pole circuit breakers in general and more particularly relates to a circuit breaker of this type having a solid state trip unit and interlocks to prevent closing of the breaker unless a rating plug for the trip unit is in place and to automatically trip the breaker when its cover is open.

Multi-pole molded case circuit breakers of relatively high current carrying capacity, such as the circuit breaker described in co-pending application Ser. No. 671,077, filed Mar. 29, 1976, are often provided with solid state trip means having removable and replaceable so-called rating plugs. The latter enable the same electronic circuitry to be utilized with different breaker ratings merely by utilizing the appropriate rating plug. However, a dangerous condition may arise if an attempt is made to close a circuit breaker in which the rating plug of a solid state trip means has not been replaced. Further, because of high available currents it is dangerous to expose internal energized elements of the circuit breaker unless the contacts thereof are open.

Thus, in accordance with the instant invention a mechanical interlock is provided to automatically trip the circuit breaker whenever the cover thereof is removed. In order to gain access to the rating plug it is necessary to remove the cover, or at least a portion thereof aligned with the rating plug. Thus, whenever the rating plug is made accessible for removal the circuit breaker is first opened automatically. Associated with the rating plug is a lockout means which prevents relatching of the circuit breaker until a rating plug is in an operative position.

Accordingly, a primary object of the instant invention is to provide a novel construction for a circuit breaker of relatively high current rating including a cover interlock for tripping the circuit breaker and a rating plug lockout device for maintaining the circuit breaker in tripped condition until a rating plug is operatively connected in circuit.

Another object is to provide a compact simplified construction for a cover interlock and rating plug lockout means.

These objects as well as other objects of this invention shall become readily apparent after reading the following description of the accompanying drawings in which.

Figure 1:
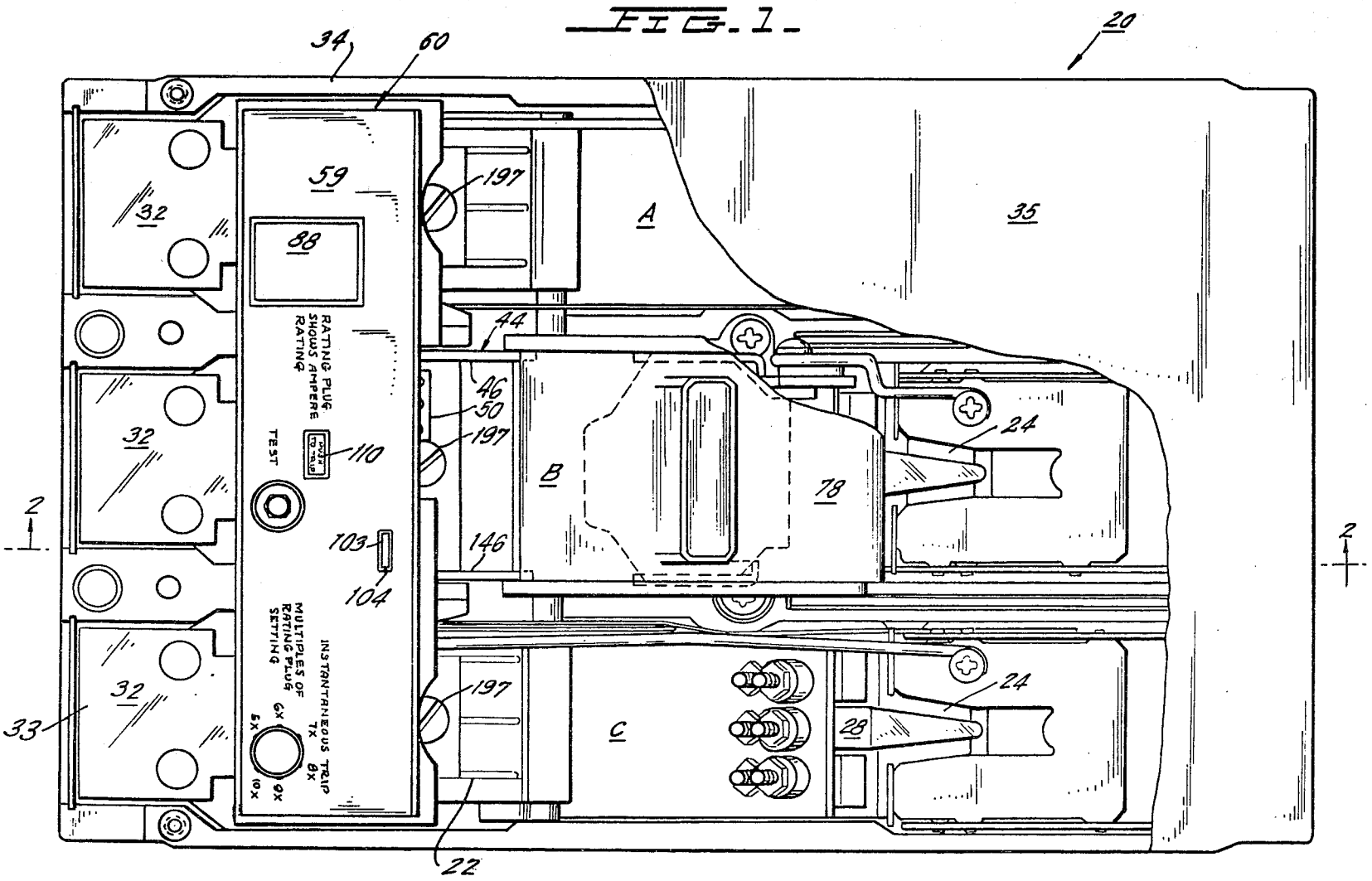
FIG. 1 is a plan view of a multi-pole circuit breaker incorporating a solid state trip unit, including cover interlock and rating plug lockout means constructed in accordance with teachings of the instant invention, with most of the molded cover of the circuit breaker being broken away to reveal internal details.
Figure 2:
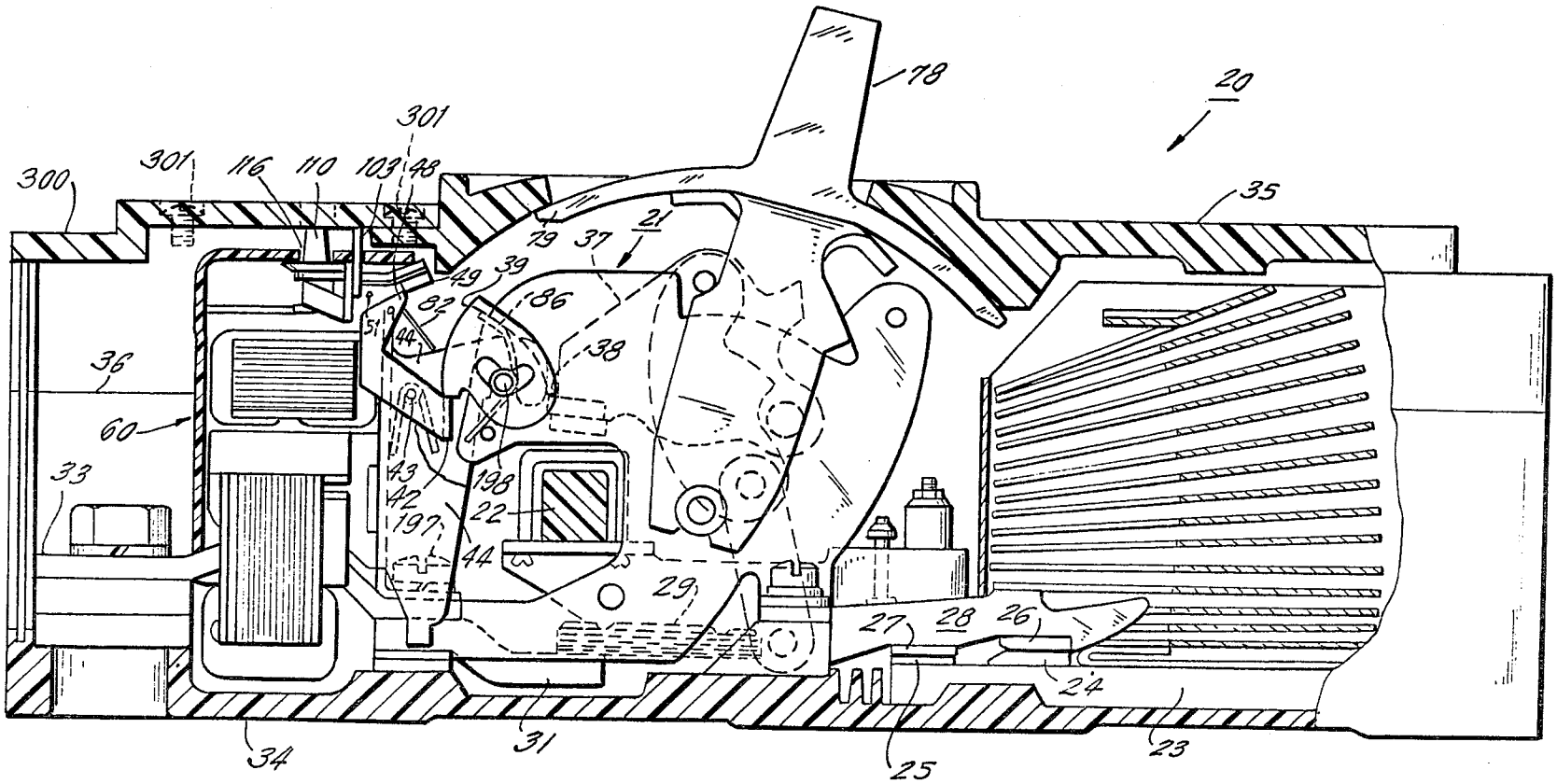
FIG. 2 is a longitudinal cross-section taken through line 2—2 of FIG. 1 looking at the direction of arrows 2—2.

Now referring to the Figures Molded case circuit breaker 20 of FIGS. 1 and 2 is provided with three poles A, B, C and a common spring powered contact operating mechanism 21 all disposed within a molded insulating housing consisting of base 34 and cover 35 which is separable from base 34 at line 36. Transverse insulating bar 22 provides a mechanical tie between poles A, B, C for simultaneous operation thereof in a manner well known to the art. As best seen in FIG. 2 the current carrying path through the center pole B consists of line terminal member 23, stationary arcing and main contacts 24, 25, movable arcing and main contacts 26, 27, movable contact arm means 28, flexible conductor 29, strap 31, and main bus section 32 which terminates in load terminal 33. The other two poles A and C have essentially the same current carrying elements as does center pole B.

Contact operating mechanism 21 is a conventional trip free spring powered over center toggle unit including releaseable cradle 37 which is normally held in the reset position shown in FIG. 2 by latching portion 38 of auxiliary latch 39. At point 41 auxiliary latch 39 is held latched by engagement with main latch 42 which is pivotally mounted on pin 43 that extends between spaced arms 45, 46 of latch support bracket 44. The end of main latch remote from point 41 is provided with nose 48 that is normally engaged by latching plate 49 on trip latch member 50. The latter is pivotally mounted on pin 51 which extends between arms 46, 52 of bracket 44. Operation of latch member 50 shall be hereinafter explained.

Figure 4:
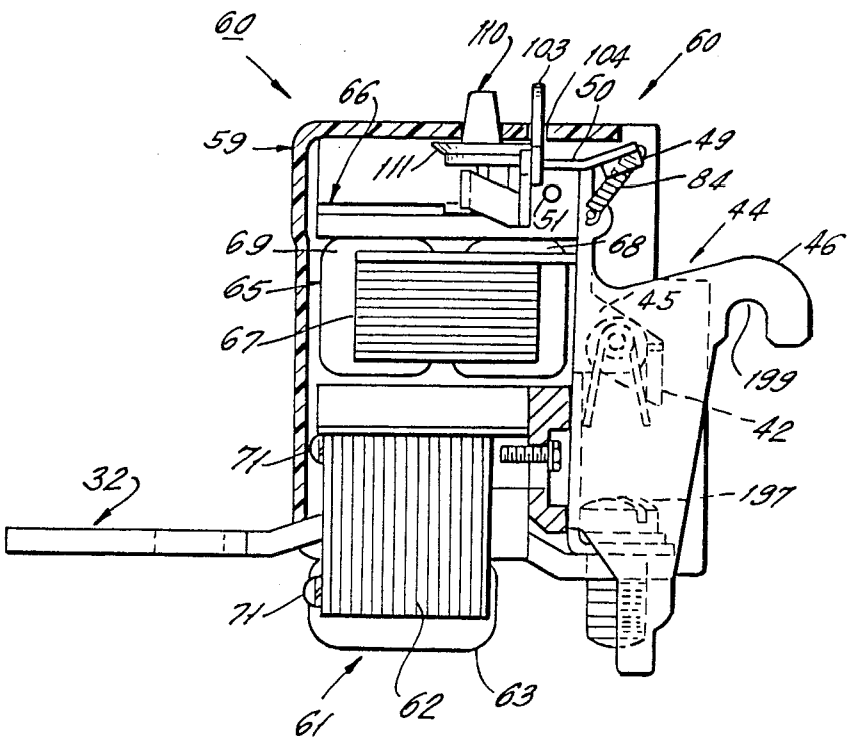
FIG. 4 is a cross-section of the trip unit taken through line 4—4 of FIG. 6 looking in the direction of arrows 4—4.
Figure 3:
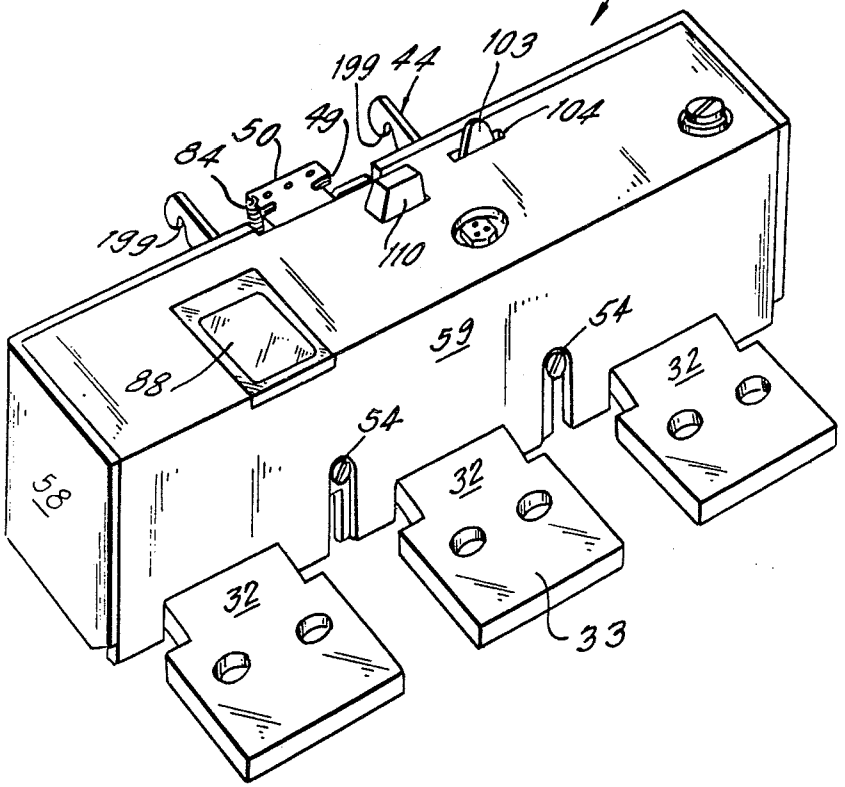
FIG. 3 is a perspective of the replaceable trip unit, looking toward the load end thereof.

Bracket 44 and the elements mounted thereto constitute a sub-assembly which together with all three main buses 32 are elements of removable and replaceable solid state trip unit 60 disposed within circuit breaker housing 34, 35 at the load end thereof. The latter also includes a common insulating frame or housing consisting of member 58 having a U-shaped cross-section and member 59 having an L-shaped cross-section, with the latter constituting a removable cover that is normally held in place by screws 54, 54. The web portion or wall 57 of member 58 extends in a plane generally perpendicular to main conductors 32. The latter are positioned at the bottom of housing 58, 59 when viewed with respect to FIGS. 3, 4 and 6, and extend beyond both the line and load sides of housing 58, 59. Bracket 44 and the elements mounted thereon constitute a sub-assembly mounted to frame member 58. The major portion of bracket 44 abuts the line side of wall 57 with pivot 51 for trip member 50 being positioned at the upper end of wall 57.

Each main bus 32 constitutes a single turn primary for an individual input transformer 61 provided for each of the circuit breaker poles A, B, C. Each input transformer 61 also includes square laminated magnetic frame or core 62 through which primary 32 extends. The multi-turn secondary of transformer 61 consists of multi-turn coils 63, 64 wound around opposite legs of core 62 and being connected in series aiding relationship. In a practical construction for a breaker having a continuous current rating of 800 amperes at 600 volts, the turns ratio of each input transformer 61 is 300:1 and the turns ratio of each output transformer 65 is 50:1.

The output of secondary 63, 64 is fed through the multi-turn primary of output transformer 65 whose secondary feeds the solid state control circuitry on circuit board 66. Output transformer 65 is provided with a square laminated magnetic frame or core 67 having coil means 68, 69 mounted on opposite legs thereof. Each of the coil means 68, 69 consists of a portion of the primary and a portion of the secondary for output transformer 65. These primary portions are connected in series aiding relationship as are these secondary portions. In total, the secondary has many more turns than the primary.

Each of the input transformers 61 is mounted on the load side of wall 57 by means of two of the four screws 71 which, in conjunction with tie bars 72, clamp the laminations of core 62. The laminations of core 67 are in planes at right angles to the planes to which the laminations of core 62 are disposed. The former are clamped together by four tie bars 73 held by rivets 74. Two of the tie bars 73 are provided with projections 75 that extend through wall 57. On the line side of wall 57 the free ends of projections 75 are staked to mechanically secure output transformer 65 in operative position on the load side of wall 57.

Figure 8:
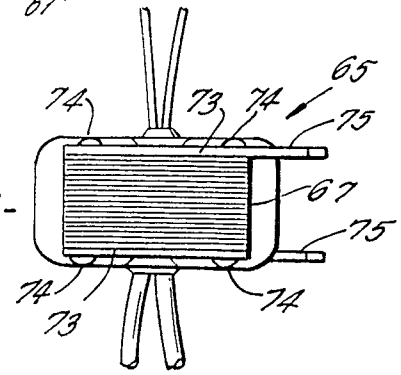
FIG. 8 is a side elevation of the output transformer of FIG. 7, looking in the direction of arrows 8—8 of FIG. 7.
Figure 7:
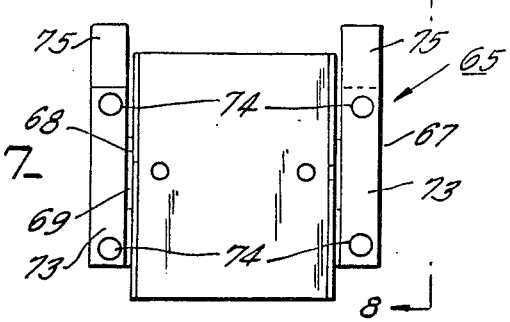
FIG. 7 is a plan view of one of the output transformers, looking in the direction of arrows 7—7 of FIG. 6.

Circuit board 66 is mounted by sliding the edges thereof in interior grooves 87 of rame member 58. As best seen in FIG. 8, all three input transformers 61 are arranged in a horizontal row below circuit board 66. Interposed between circuit board 66 and the row of transformers 61 is another horizontal row containing all three output transformers 61 is another horizontal row containing all three output transformers 65 together with permanent magnet latch 76. The latter is described in detail in the George Gaskill co-pending application Ser. No. 656,108, filed Feb. 9, 1976, now U.S. Pat. No. 3,984,795 for an Improved Magnetic Latch Construction, and assigned to the assignee of the instant invention. Latch 76 includes actuator 77 biased to the right with respect to FIG. 4 and normally held in retracted position against its biasing force by a permanent magnet (not shown). In a manner well known to the art, plunger 77 is released by the permanent magnet when flux generated by the latter is bucked by a flux field resulting from an output signal generated by the control circuitry of board 66 when predetermined fault current conditions exist at one or more of the main buses 32. The construction and operation of the control circuit is illustrated and described in the L. Davis and P. Pang co-pending application Ser. No. 658,354, filed Feb. 17, 1976 for a Solid State Tripping Circuit and assigned to the assignee of the instant invention.

Figure 10:
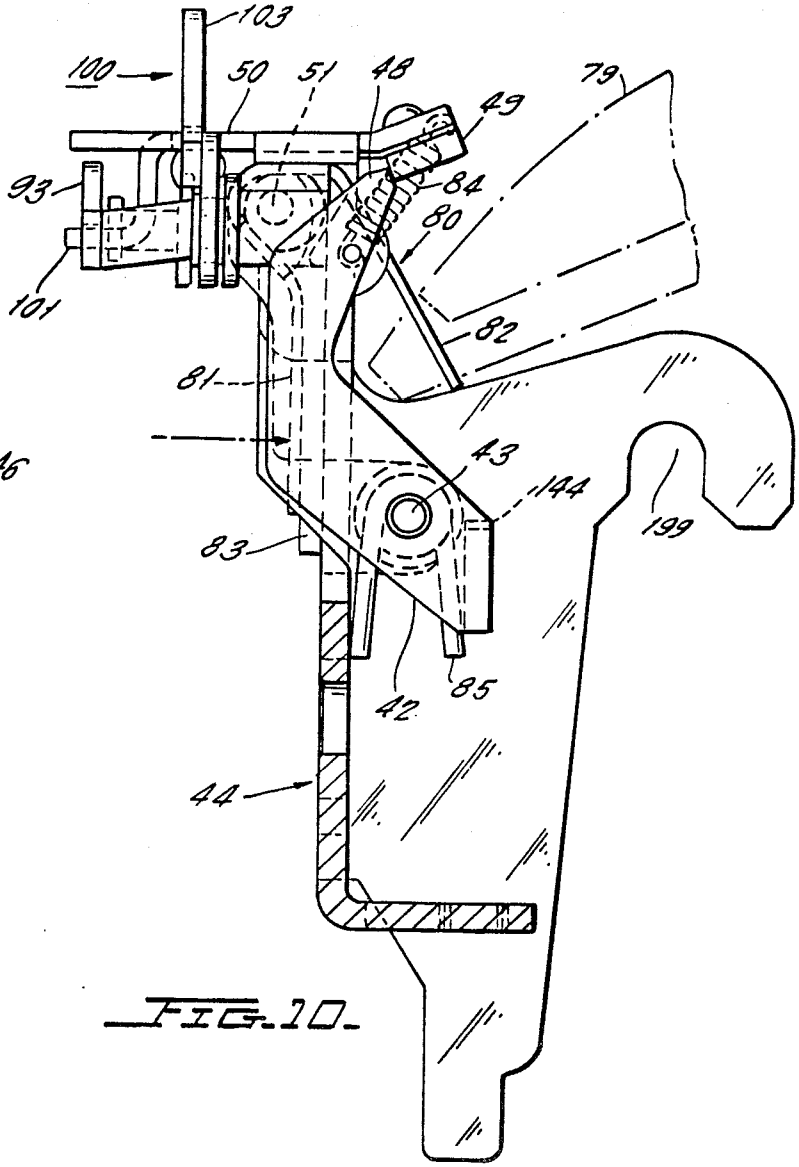
FIG. 10 is a side elevation of the mechanical latch sub-assembly, looking in the direction of arrows 10—10 of FIG. 9.
Figure 9:
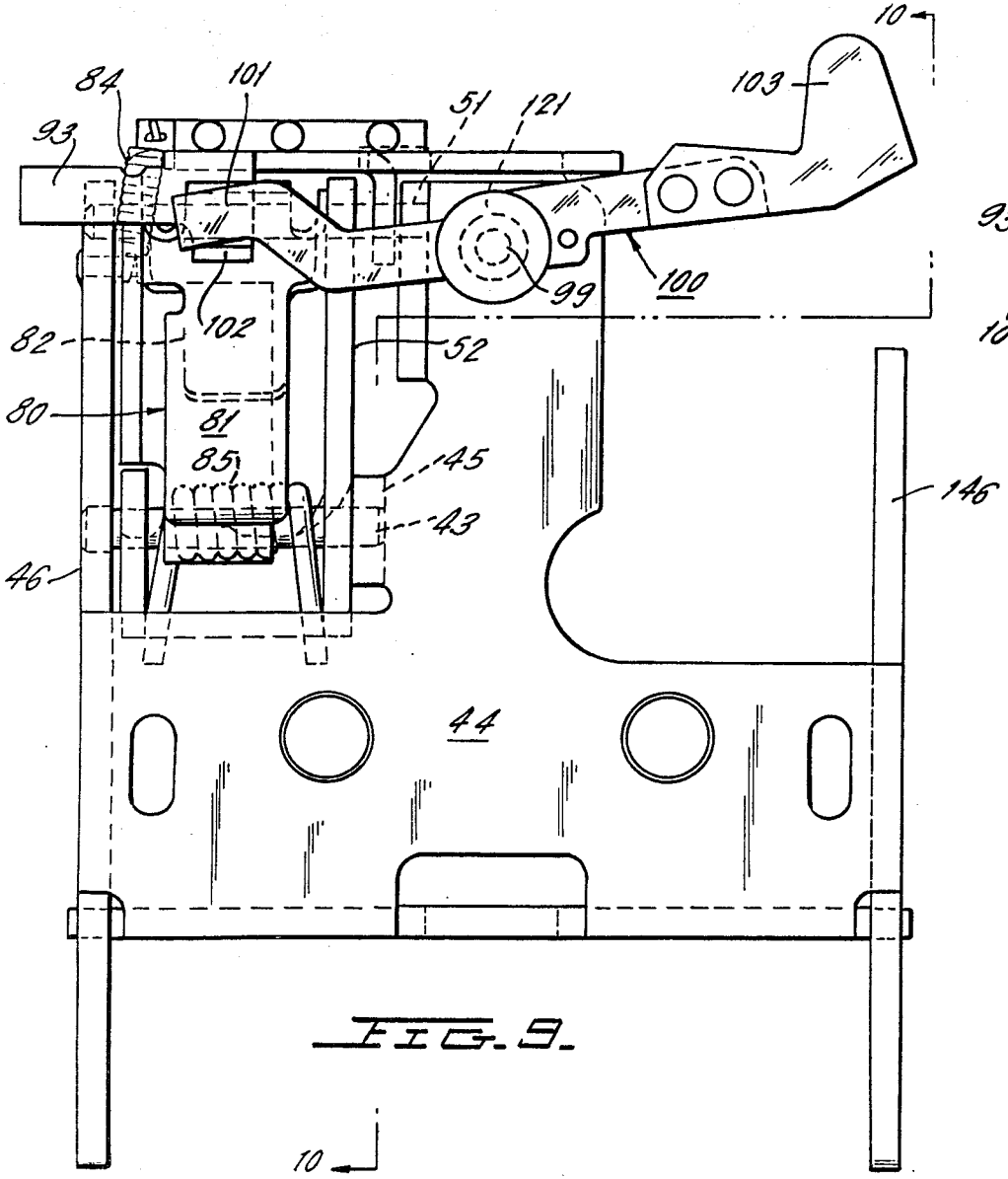
FIG. 9 is an enlarged elevation looking at the load side of the mechanical latch sub-assembly.

When actuator 77 is released and moves to the right with respect to FIG. 10 it engages arm 81 of reset member 80. The latter is constructed of relatively stiff spring metal sheet material and is pivoted on pin 51 together with trip member 50. Arm 81 is adjacent to arm 83 of trip member 50 so that the releasing or tripping motion of actuator 77 is transmitted by arm 81 to arm 83 thereby pivoting tripping member 50 in a counterclockwise direction. This releases nose 48 of main latch 42 from latch plate 49 permitting main latch 42 to pivot clockwise about pin 43 thereby releasing auxiliary latch 39 so that cradle 37 is free to move to its trip position under the influence of the main operating springs of contact operating mechanism 21.

In order to reset actuator 77 of permanent magnet latch 76, circuit breaker handle 78 is manually moved to the left with respect to FIG. 2 with handle guide extension 79 engaging arm 82 of reset member 80 causing member 80 to pivot clockwise with respect to FIG. 10 so that arm 81 engages the nose of actuator 77 moving the latter to the left with respect to FIG. 10 to its retracted or reset position where actuator 77 is held by the permanent magnet of latch 76. Tension spring 84 is then free to pivot trip member 50 clockwise to latch nose 48 behind bar 49. Torsion spring 85 biases main latch member 42 counterclockwise toward its reset position and another torsion spring 86 biases auxiliary latch 39 toward its reset position.

The relative positioning of main latch 42 with respect to auxiliary latch 39 is achieved by having hook formations 199 at the line ends of arms 46, 146 of bracket 44 receive pin 198. The latter is supported by the frame of contact operating mechanism 21 and provides a pivot for auxiliary latch member 39. Removable screws 197, extending through clearance apertures 196 in the line ends of buses 32, provides contact pressure between buses 32 and straps 31.

Figure 5:
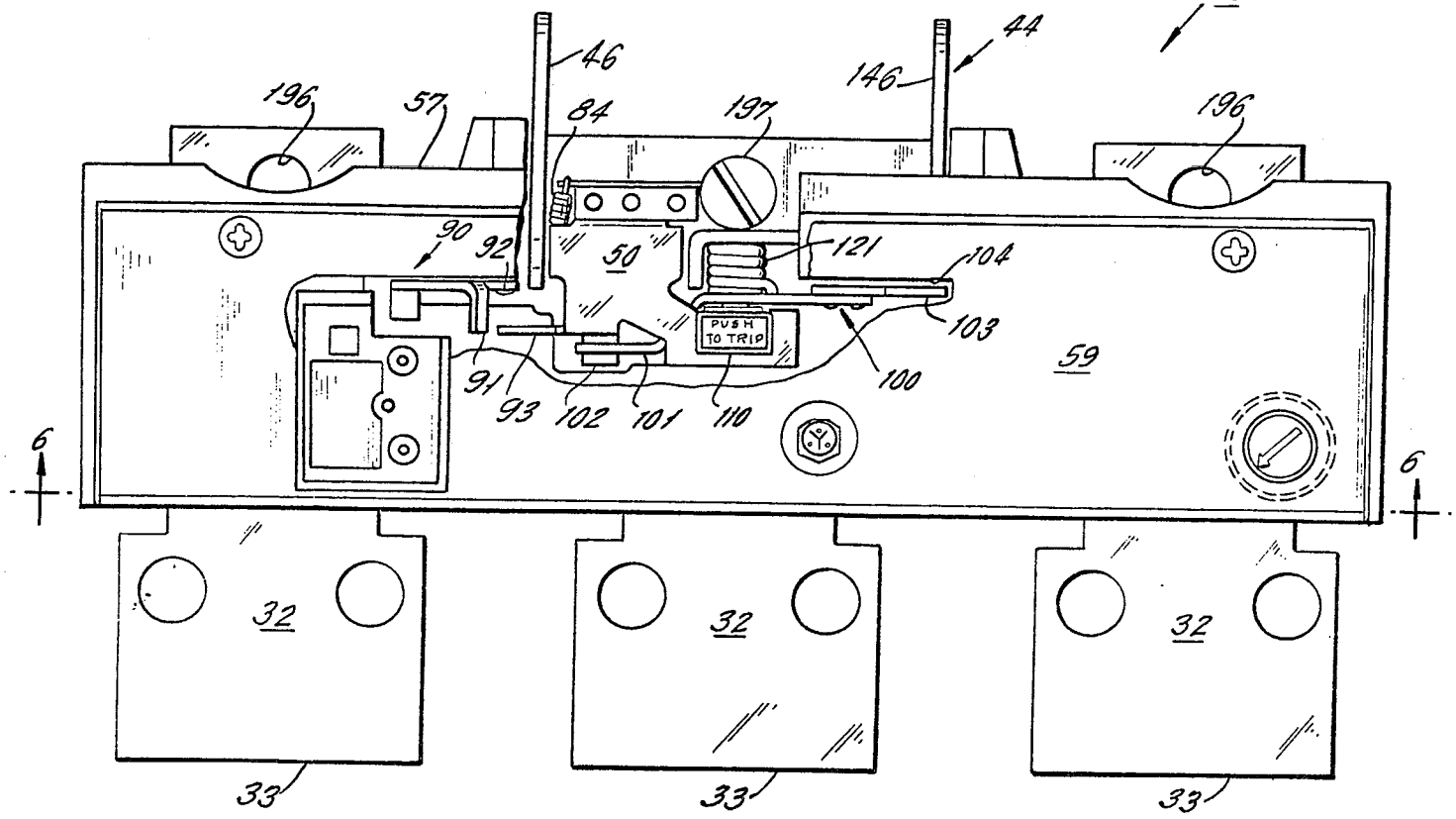
FIG. 5 is a plan view of the trip unit of FIG. 3 with a portion of the cover broken away.
Figure 6:
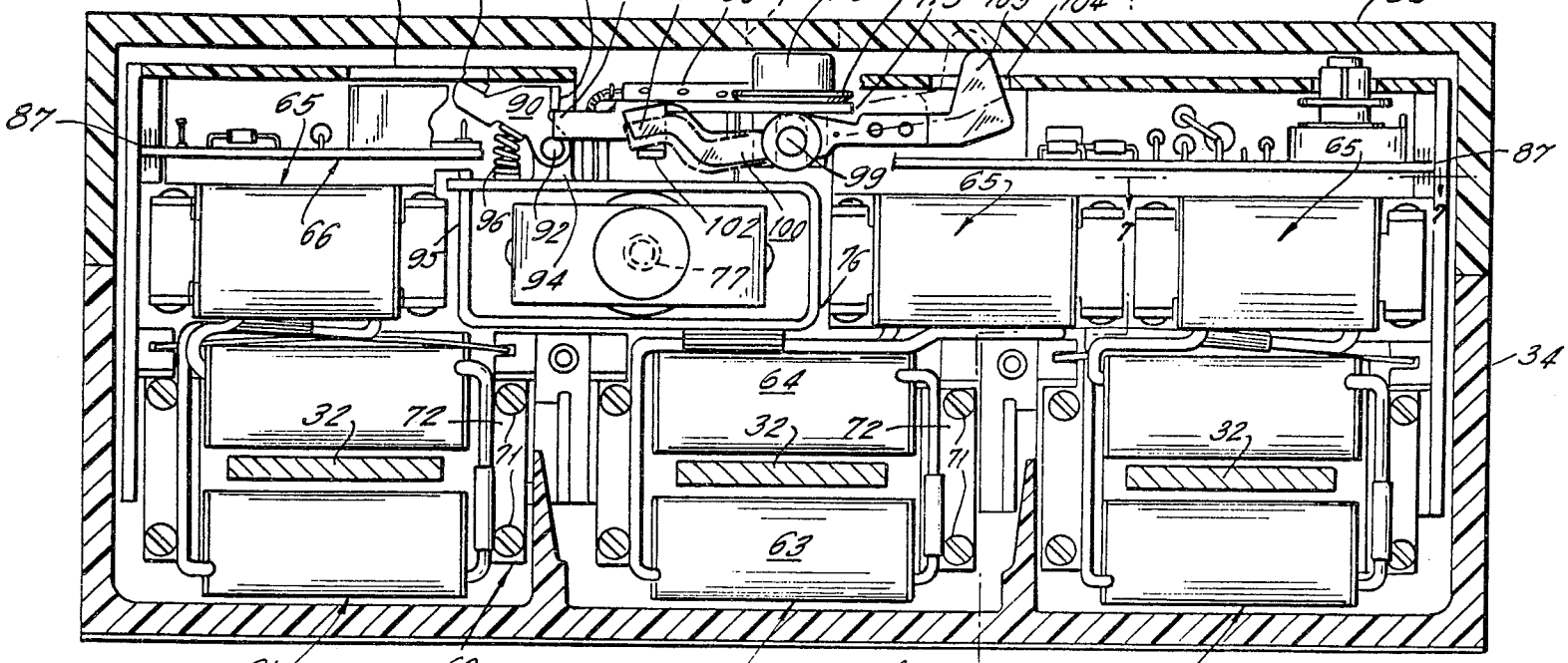
FIG. 6 is a cross-section of trip unit, taken through line 6—6 of FIG. 5 looking in the direction of arrows 6—6.

Cover interlock unit 100 is mounted near its center on pivot 99 and is biased counterclockwise with respect to FIG. 6 by torsion spring 121 (FIG. 5) so that end 101 engages projection 102 of trip latch member 50 to move member 50 counterclockwise with respect to FIG. 10 to its tripping position. The end of member 100 remote from end 101 is provided with upwardly extending nose 103 that projects through clearance slot 104 in cover 59 of trip unit housing 58, 59. As the circuit breaker housing cover 35 is mounted to base 34, the inside surface of cover portion 300 engages nose 103 to move the latter from the phantom position thereof. Cover portion 300, which may be transparent, extends the full width of cover 35 and is removably secured to the other section of cover 35 by screws 301. Portion 300 also extends in front of rating plug 88. Plug 88 includes at least one element, such as a resistor or capacitor, which determines the operating range of the electronic processing circuitry of board 66.

With cover portion 300 in place, cover interlock 100 is pivoted clockwise with respect to FIG. 6 so that end 101 is raised to a position such that trip member 50 may move clockwise with respect to FIG. 10 to a position wherein latch plates 49 holds latch 42 in latching position. When cover 35 or portion 300 thereof is opened, torsion spring 121 pivots unit 100 clockwise thereby operating trip latch member 50 counterclockwise with respect to FIG. 10 to release latch 42.

Circuit board 66 includes frictionally held rating plug 88 which, when fully inserted into receptacle 188 (FIG. 6), engages ear 89 of plug interlock or lockout member 90 to pivot same counterclockwise about rivet 92 as a center so that latching ear 91 of member 90 moves clear of extension 93 on latch member 50. Rivet 92 extends through ear 94 which projects upward from shield housing 95 of permanent magnet latch 76. Coiled compression spring 96 is interposed between shield 95 and lockout member 90 so that when rating plug 88 is removed member 90 pivots clockwise, with ear 91 thereof engaging extension 93 locking trip member 50 in the tripped position to which it had previously been moved by cover interlock unit 100.

It is noted that while spring 121 for cover interlock 100 is strong enough to trip breaker 20, rating plug lockout spring 96 is not strong enough to trip breaker 20. However, spring 96 is strong enough to hold trip member 50 in tripped position once it has been operated thereto by cover interlock unit 100. Thus, cover interlock 100 is a tripping device while rating plug lockout interlock 90 is a latching device.

Manually operable trip actuator member 110 projects upward through aperture 116 in trip unit housing cover 59. The lower end of member 110 is bifurcated and straddles pin 99 which acts to guide member 110 as it is being depressed. Flange 111 of member 110 is disposed inside of trip unit housing 58, 59 and is supported on trip member extension 115 so that when member 110 is depressed latch member 50 is pivoted counterclockwise about pin 51 with respect to FIG. 10 to release nose 48 of main latch 42 from latch plate 49 thereby tripping operating mechanism 21.

Thus, it is seen that the instant invention provides a compact construction for a solid state automatic tripping unit for molded case circuit breakers for relatively high current ratings. The construction is such that it includes an interlock that trips the circuit breaker when its cover is opened, and a lockout means that prevents resetting of the breaker when a rating plug is not in place.

Although there has been described a preferred embodiment of this invention, many variations and modifications will now be apparent to those skilled in the art. Therefore, this invention is to be limited, not by the specific disclosure herein, but only by the appended claims.

What is claimed is:

1. A multi-pole molded case circuit breaker including cooperating contact means; an operating mechanism for opening and closing said contact means; latch means for maintaining said mechanism in a reset condition; solid state trip means including circuitry for processing fault signals derived from currents flowing through said circuit breaker; said trip means including a removable and replaceable first means including an element of said circuitry which controls rating characteristics thereof; a housing wherein said contact means, said mechanism, said latch means and said trip means are disposed; interlock means biased to a first position in operative engagement with said latch means to release the latch and thereby trip said mechanism; said housing including cover means which when in a closed position operating said interlock means to a second position wherein said latch means is permitted to be returned to a latching position; lockout means biased to a first position in operative engagement to block movement of said latch means to its said latching position; said first means when operatively connected in said circuitry operating said lockout means to a second position wherein said latch means is permitted to be returned to said latching position.

2. A multi-pole molded case circuit breaker as set forth in claim 1 in which said cover means must be open in order to gain access to said first means for removal and replacement thereof.

3. A multi-pole molded case circuit breaker as set forth in claim 2 in which the interlock means is pivotally mounted on a pin means; a control accessible for operation from outside the housing to trip said latch means; said pin means operatively positioning said control.

4. A multi-pole molded case circuit breaker as set forth in claim 3 in which the control is depressible for tripping said latch means.

5. A multi-pole molded case circuit breaker as set forth in claim 2 in which there is a first biasing means urging the interlock means to its said first position; said first biasing means generating sufficient energy to trip said latch means and said second biasing means generating insufficient energy to trip said latch means.

6. A multi-pole molded case circuit breaker as set forth in claim 5 in which the interlock means is pivotally mounted on a pin means; a control accessible for operation from outside the housing to trip said latch means; said pin means operatively positioning said control.

7. A multi-pole molded case circuit breaker as set forth in claim 6 in which the control is depressible for tripping said latch means.

* * * * *